US006273444B1

(12) United States Patent
Power

(10) Patent No.: US 6,273,444 B1
(45) Date of Patent: Aug. 14, 2001

(54) APPARATUS FOR COUPLING WHEELCHAIRS TO VENTILATOR CARTS

(75) Inventor: John S. Power, Moycullen (IE)

(73) Assignee: Mallinckrodt Inc., Hazelwood, MO (US)

( * ) Notice: Subject to any disclaimer, the term of this patent is extended or adjusted under 35 U.S.C. 154(b) by 0 days.

(21) Appl. No.: 09/281,835

(22) Filed: Mar. 31, 1999

(51) Int. Cl.[7] ..... A47C 7/62
(52) U.S. Cl. ..... 280/304.1; 280/204
(58) Field of Search ..... 280/304.1, 297, 280/DIG. 4, 250.1, 32.7, 292, 460.1, 461.1, 204; 180/19.1, 11

(56) References Cited

U.S. PATENT DOCUMENTS 3,405,954 * 10/1968 Wolfe ..... 280/304.1
4,305,601 * 12/1981 Berge ..... 280/304.1
4,506,903 3/1985 Bowermaster .
5,009,442 * 4/1991 Schneider ..... 280/304.1
5,219,139 * 6/1993 Hertzler et al. ..... 280/304.1
5,236,213 * 8/1993 Trickett ..... 280/304.1
5,340,140 * 8/1994 Bynum ..... 280/304.1
5,355,539 10/1994 Boettger .
5,509,680 * 4/1996 Scharf et al. ..... 280/304.1

* cited by examiner

*Primary Examiner*—Brian L. Johnson
*Assistant Examiner*—Elaine Gort
(74) *Attorney, Agent, or Firm*—Hovey, Williams, Timmons & Collins

(57) ABSTRACT

A wheelchair cart configured for rollable transportation while carrying medical gas or other equipment is provided having a linkage assembly operable for linking the cart with a wheelchair while allowing the wheelchair/cart assembly to pass over uneven surfaces. The cart allows a single person to connect the cart to a wheelchair and transport the two simultaneously. The cart is configured such that equipment that should be transported with the patient and is often physically connected to the patient (e.g. ventilators, IV's, and monitors) is stored and transported on the cart. Risks associated with disconnecting the patient from vital medical equipment are minimized by eliminating the typical separate transportation of an equipment cart and a wheelchair by more than one person, which may result in a stretching or breaking of the attachment lines between the patient and the equipment.

6 Claims, 4 Drawing Sheets

APPARATUS FOR COUPLING WHEELCHAIRS TO VENTILATOR CARTS

BACKGROUND OF THE INVENTION

1. Field of the Invention

The present invention is broadly concerned with improved carts particularly designed for use in conjunction with wheelchairs. More particularly, the invention pertains to such carts wherein the carts may be releasably attached to any conventional wheelchair through an attachment system adapted to accommodate travel over uneven surfaces. In preferred forms the cart is configured to hold and transport items necessary for the care of the person utilizing the wheelchair. The present invention allows one caregiver to transport a patient in a wheelchair while simultaneously transporting other items necessary for the patient's care all while minimizing the risk of disconnecting the patient from any equipment connected to them.

2. Description of the Prior Art

In the health care field, much time and labor is spent transporting patients in wheelchairs and hospital gurneys. Many patients needing to be transported have other items or equipment associated with their health care needs that should be transported simultaneously with the patient. Often, the patient is physically attached to some items or equipment such as intravenous tubes (IV's), heart monitoring equipment, oxygen, ventilators, and respirators. Serious problems may arise if the patient is disconnected from these items, even if the disconnection is a relatively short and temporary one. Furthermore, some disconnections are not immediately noticeable by the healthcare provider, especially if the patient is sleeping, unconscious or unable to communicate effectively. Transporting these patients and their associated items generally requires the labor of at least two people, one to push the wheelchair or gurney and at least one to transport the other equipment. This presents the problem of moving the patient in unison with the equipment and minimizing the possibility of disconnecting the patient from any connected equipment since all people transporting must move together in a coordinated fashion. This is often very difficult to do if transporting the patient requires maneuvering around corners, over uneven surfaces, through crowded corridors or doors, or in places where there is only a small area available for any needed maneuvering (such as a hospital or nursing home room). If the people transporting do not move the patient in unison with their connected equipment, the risk of disconnecting the patient from the equipment rises. Furthermore, many health care facilities have responded to increasing costs and overhead by reducing the size of their labor force resulting in a shortage of labor available to transport patients. This may encourage the cutting of corners by employing just one person to transport both patient and equipment when more than one may be required to safely transport the patient and their equipment using currently available transportation equipment.

Other problems occur, using currently available transportation equipment, due to the transferring of equipment from a bedside to a carrier for transportation. If the equipment is heavy, there is a risk of backstrain to the healthcare provider. Furthermore, the equipment may be accidentally dropped or operational settings may be inadvertently changed if the controls are accidentally contacted by the caregiver. If there is not a convenient place to mount the equipment during transportation, the equipment may be placed in a position, including underneath the wheelchair or gurney, that reduces the visibility of any display the equipment may have.

Additionally, owing to a lack of space, the equipment may have to be placed in an area that is inconvenient to access in emergency situations. This is especially true when equipment is mounted under a wheelchair or gurney for transportation. Mounting equipment under a wheelchair also subjects the equipment to possible damage due to incontinent patients.

Consequently, there is a need for an apparatus that reduces the number of people required to transport a patient when there is other equipment that must be transported simultaneously with the patient. There is also a need for an apparatus that minimizes the possibility of disconnecting a patient from any equipment to which they are connected. Another need in the art is an apparatus that minimizes the possibility of inadvertently changing the operational settings of that equipment during transportation. What is also needed is an apparatus that may be used as a standalone bedside unit to store equipment and a transportation unit which can be quickly and easily connected to a wheelchair for transportation. What is still further needed is an apparatus configured to hold equipment at a normal operating level allowing clear visibility at all times and easy access in emergency situations. Finally, what is needed is an apparatus designed to be connected to a wheelchair or gurney that is configured to hold and transport equipment such that one person can efficiently and safely transport both a patient and their equipment.

SUMMARY OF THE INVENTION

The present invention overcomes the problems outlined above and provides an apparatus configured to be releasably connected to a wheelchair or gurney which allows for a single caregiver to transport a patient and any associated equipment safely and efficiently. In addition, the present invention minimizes the risks associated with accidentally disconnecting a patient from medical equipment by minimizing strain on the connecting tubes or wires caused by increasing the distance between the patient and the equipment. A further advantage of the present invention is that by virtue of attaching a cart to a wheelchair, the resulting combination makes a stable walking trainer for patient therapy. Another advantage of the present invention is that the cart may be used as the normal bedside holder of the equipment, that is, the cart may act as a stand-alone unit thereby reducing the number of times that a person has to lift the equipment and place it either onto a separate cart for transportation or another cart or table for standalone use. By having the equipment already located on the cart, the risk of dropping the equipment when transferring it from its bedside position to the cart is reduced. This also reduces the danger of backstrain on the person transferring the equipment from the bedside to its transportation carrier. The connecting assembly system of the present invention provides a quick and easy way to couple the cart with a wheelchair and advantageously allows for accommodation of strain when the wheelchair and cart are moving over uneven surfaces.

The present invention is also configured to hold the equipment at its normal operating height allowing the display to remain visible at all times during transportation. The present invention also allows for easy access to the equipment in emergency situations and eliminates the risk of equipment damage due to incontinent patients. Another advantage of the present invention is that accidental contact with equipment resulting in changes to operational settings ofthe equipment is minimized. Finally, the present invention allows unconnected patient transport for several hours since the cart is configured to hold oxygen cylinders and a large external battery to power any equipment.

The apparatus of the present invention comprises a cart configured to be releasably connectable to a wheelchair or gurney; as used herein, "wheelchair" refers to conventional wheelchairs, gurneys where a patient is transported in a recumbent position, and all other wheeled patient transport devices. The cart is also configured to hold oxygen cylinders and other equipment at a normal operating level that is visible at all times and easily accessible in emergency situations. The cart includes wheels to facilitate transportation. In preferred forms, the cart will have more than one connecting assembly system in order to allow connection to a wide variety of different sizes and shapes of conventional wheelchairs and gurneys.

BRIEF DESCRIPTION OF THE DRAWINGS

A preferred embodiment of the present invention is described in detail below with reference to the attached drawing figures, wherein.

DETAILED DESCRIPTION OF THE PREFERRED EMBODIMENT

The following description and examples set forth preferred embodiments of the present invention. It is to be understood, however, that these examples are provided by way of illustration and nothing therein should be taken as a limitation upon the overall scope of the invention.

Figure 1:
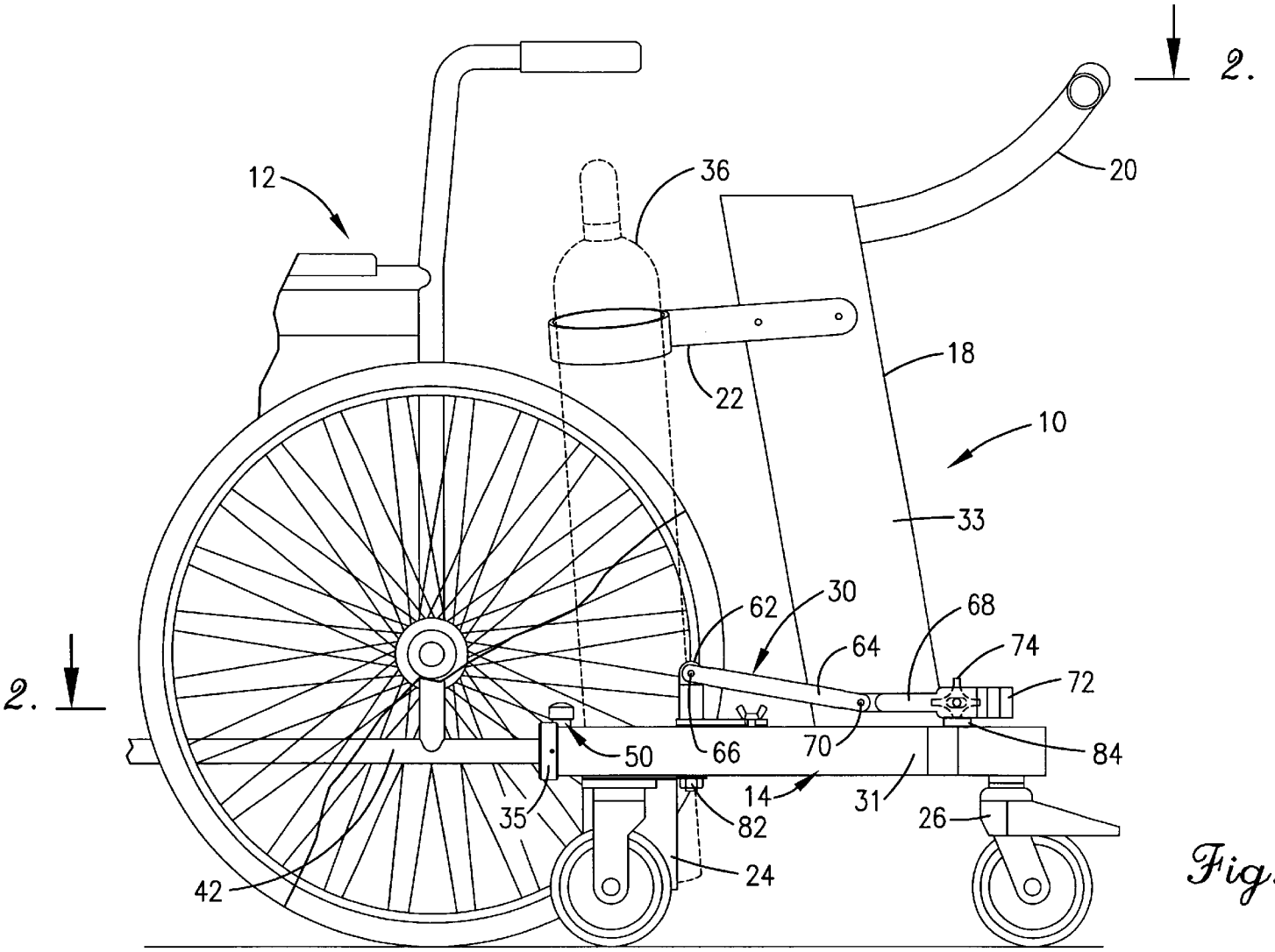
FIG. 1 is a fragmentary side view of a preferred cart in accordance with the present invention attached to a conventional wheelchair by a frame pin assembly system.

Turning now to the drawings wherein like reference numerals are used for all figures, FIG. 1 depicts a preferred cart 10 in accordance with the present invention releasably attached to a wheelchair 12. The cart 10 includes a metallic apertured tubular cart frame 14, base 16, upright member 18, handle 20, u-shaped oxygen holder brackets 22, oxygen holder base 24, castors 26, a frame pin linkage assembly 28 and a linkage arm assembly 30.

Cart 10 comprises a tubular cart frame 14 made up of side marginal tubular legs 31 astride and supporting base 16. Each leg 31 presents an open forward end 32 formed by the interior surfaces 34 of the respective legs 31 and an annular cap 35 covering the legs 31 but not the forward ends 32. The base 16 is secured to the frame legs 31 and acts as a mounting deck for upright member 18 which is configured to extend vertically from cart base 16. Upright member 18 may be provided with a pair of sidewalls 33 supporting rearwardly extending shelves (not shown); these shelves provide a convenient place to store equipment at at a level that is easily visible as well as accessible. Upright member 18 is also configured and positioned such that it is difficult for the caregiver to accidentally contact stored equipment and change operational settings on any of such equipment.

Figure 5:
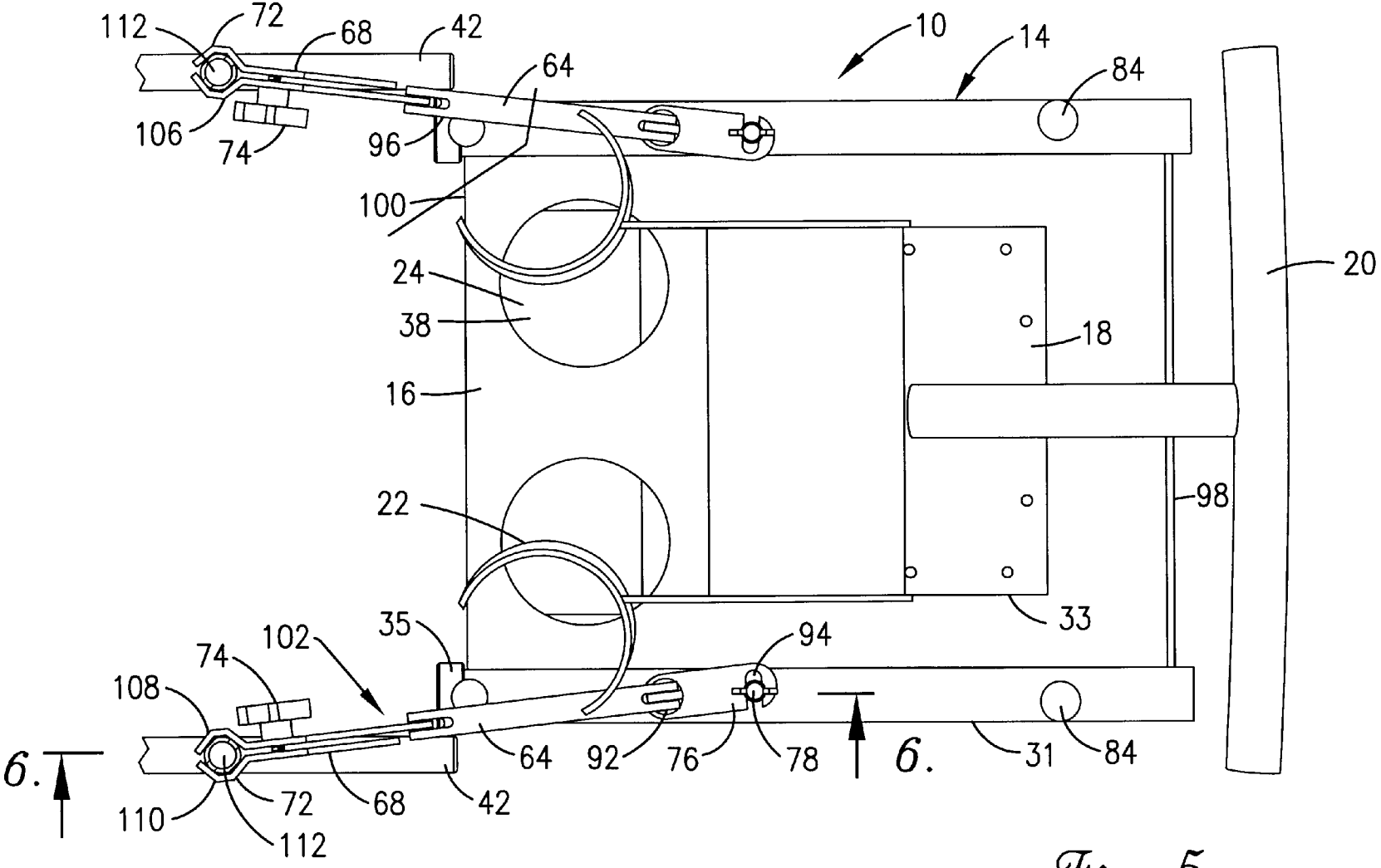
FIG. 5 is a fragmentary top view of a cart in accordance with the present invention showing a linkage arm assembly connected to the downstrut of a wheelchair.

Cart handle 20 is attached to and extends rearwardly from upright member 18 and provides an ergonomically efficient position from which the cart 10 can be pushed. A pair of u-shaped oxygen holder brackets 22 are also attached to the sidewalls 33 of member 18 (as shown in FIG. 5) and are configured to releasably secure gas cylinders 36.

The bottom of each cylinder 36 may be supported by the cart base 16 or by the depending U-shaped base 24. In order to provide additional clearance for cylinders 36, a pair of cylinder openings 38 are provided through the cart base 16, as shown above. Base 24 depends from cart base 16 below the openings 38 and is configured to support the bottoms of cylinders 36. Alternatively, there may be a separate base for each cylinder 36 or base 24 may extend for substantially the entirety ofthe width of cart base 16.

Castors 26 are secured to and depend from base 16 and legs 31. Preferably, castors 26 are attached to the legs 31 and base 16 near each comer of the cart 10, so as to provide cart 10 with stability during transportation and when under load stress.

Figure 3:
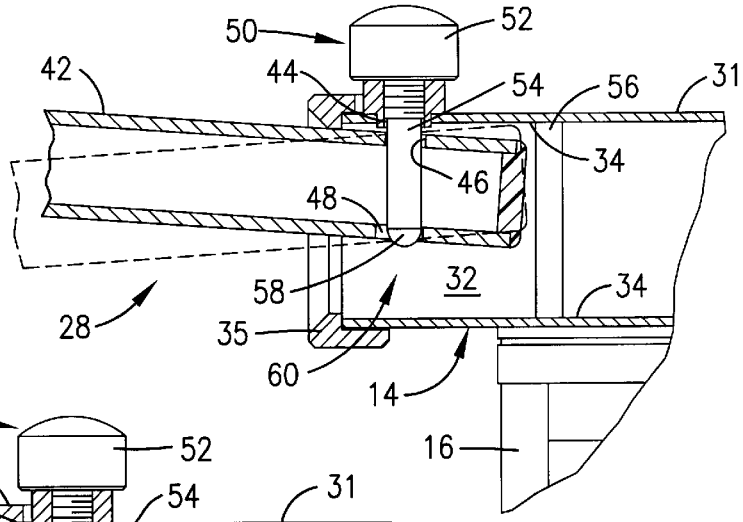
FIG. 3 is a is a fragmentary vertical cross sectional view taken along line 3—3 of FIG. 2 showing the tubular foot lever cooperating with the frame pin assembly in both phantom and full lines.
Figure 4:
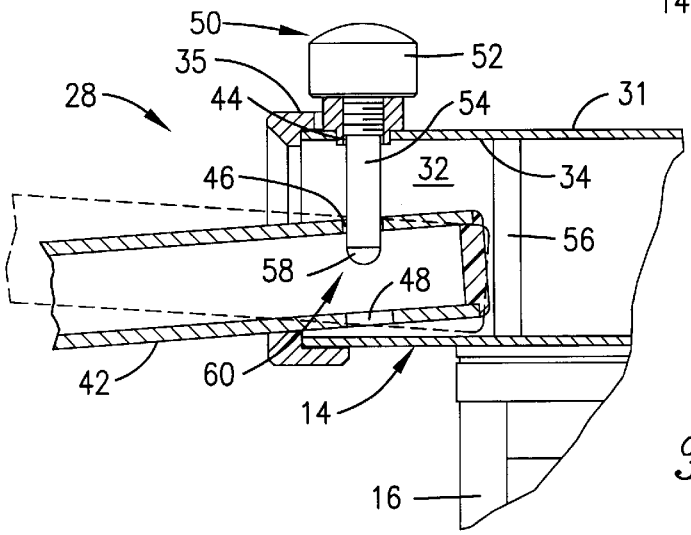
FIG. 4 is another fragmentary vertical cross sectional view taken along line 3—3 of FIG. 2 showing the tubular foot lever cooperating with the frame pin assembly in both phantom and full lines.

The present invention preferably includes two separate but not necessarily mutually exclusive linkage assemblies. A preferred frame pin linkage assembly 28 operable with a particular range of wheelchairs 12 which incorporate custom location holes 46, 48 through their tubular foot levers 42 is illustrated in FIGS. 3 and 4. The assembly 28 cooperates with the forward open ends 32 of the frame legs 31, and includes frame pin openings 44 in each leg 31, and frame pins 50 having heads 52 and shafts 54. Pin openings 44 extend through the top surface of frame legs 31 as illustrated. The pin openings 48 are of a larger diameter than the corresponding openings 46. The open ends 32 of the frame legs 31 have a larger diameter than the wheelchair tubular foot levers 42 so as to receive the latter 42 therein. Vertical pin endstops 56 are located respectively within each open end 32 to limit the insertion of tubular foot lever 42 thereon.

Frame pin shafts 54 are insertable into frame pin openings 44,46 such that when the two openings 44, 46 are in alignment, the shafts 54 extend through both openings 44, 46. Shafts 54 are also extendable through pin openings 48 as shown in FIG. 3, especially when cart 10 and wheelchair 12 are moving over uneven surfaces. Frame pins 50, when shafts 54 are inserted through pin openings 44, 46 are configured to securely retain levers 42 within open ends 32, thereby coupling the wheelchair 12 with the cart 10.

The configuration of assembly 28 allows for pivoting between the cart 10 and wheelchair 12 when coupled together as illustrated in FIGS. 3 and 4. When the wheelchair 12 encounters an upward slope (FIG. 3), levers 42 rock or pivot within open ends 32. Before pivoting, shafts 54 normally extend through pin openings 44 and pin openings 46. As an upward slope is encountered, levers 42 pivot upward and shafts 54, preferably with bullet-shaped noses 58 at their distal ends 60, locate and extend through pin openings 48. This reduces the loading of shear forces on shafts 54 at pin openings 46. Shafts 54 remain extended through pin openings 44, 46, 48 until the upward slope evens out at which time, levers 42 pivot down and shafts 54 slide out of pin openings 48, but remain extended through pin openings 46.

When wheelchair 12 encounters a downward slope (FIG. 4), levers 42 rock or pivot within open ends 32. Shafts 54 remain extended through pin openings 44 and 46 and cart 10 remains securely attached to wheelchair 12. This pivotability greatly reduces the possibility of the wheelchair 12 becoming accidentally detached from the cart 10 and thereby straining or disconnecting any wires or tubes connecting the patient with the equipment.

Figure 2:
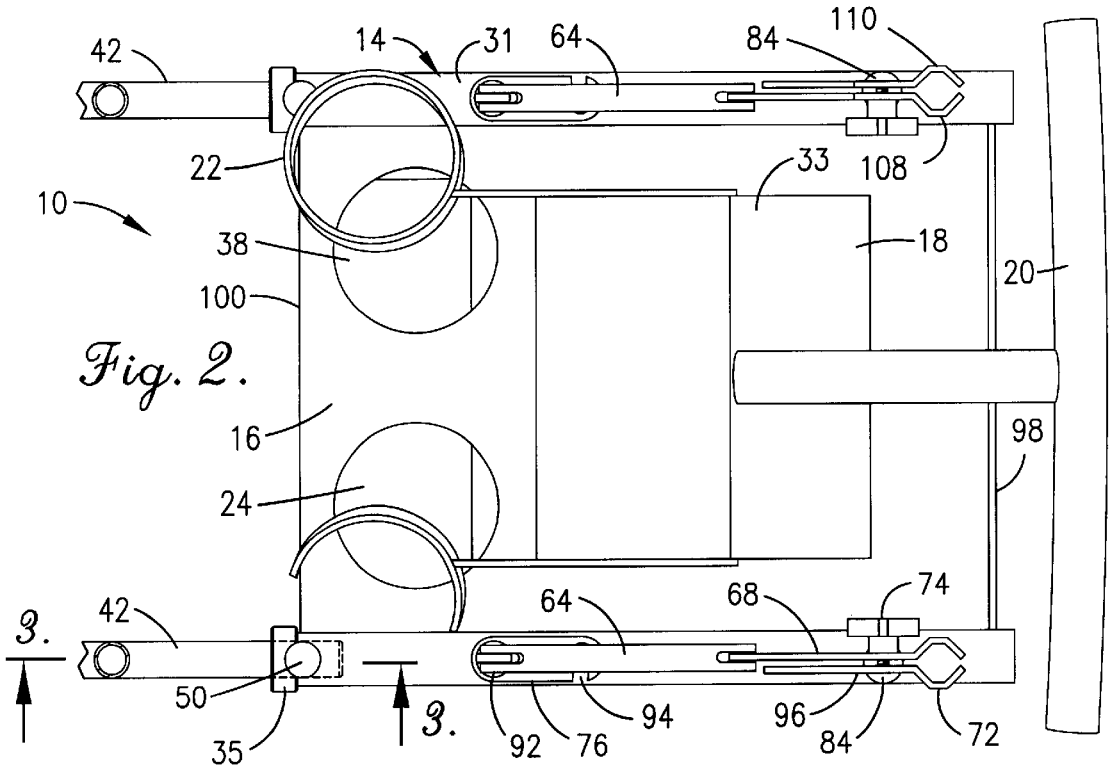
FIG. 2 is a fragmentary top view of a preferred cart in accordance with the present invention taken along uneven vertical line 2—2 of FIG. 1 and illustrating the cart and two preferred connecting assembly systems.
Figure 6:
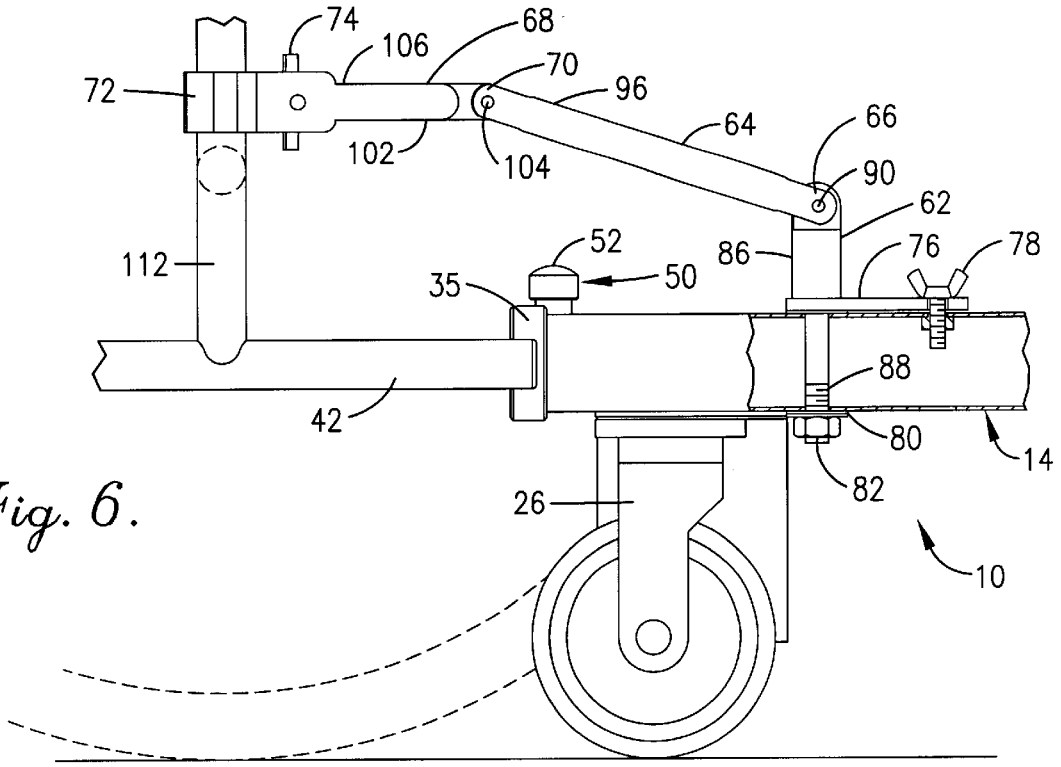
FIG. 6 is a fragmentary vertical cross sectional view taken along line 6—6 of FIG. 5 illustrating a preferred attachment pin assembly securing a linkage arm assembly which is extended and connected to a tubular downstrut of a conventional wheelchair; and, FIG. 7 is a fragmentary side view of a preferred linkage arm taken along line 6—6 of FIG. 5 showing the linkage arm assembly connected to the downstrut of a wheelchair and accommodating an uneven transportation surface.
Figure 7:
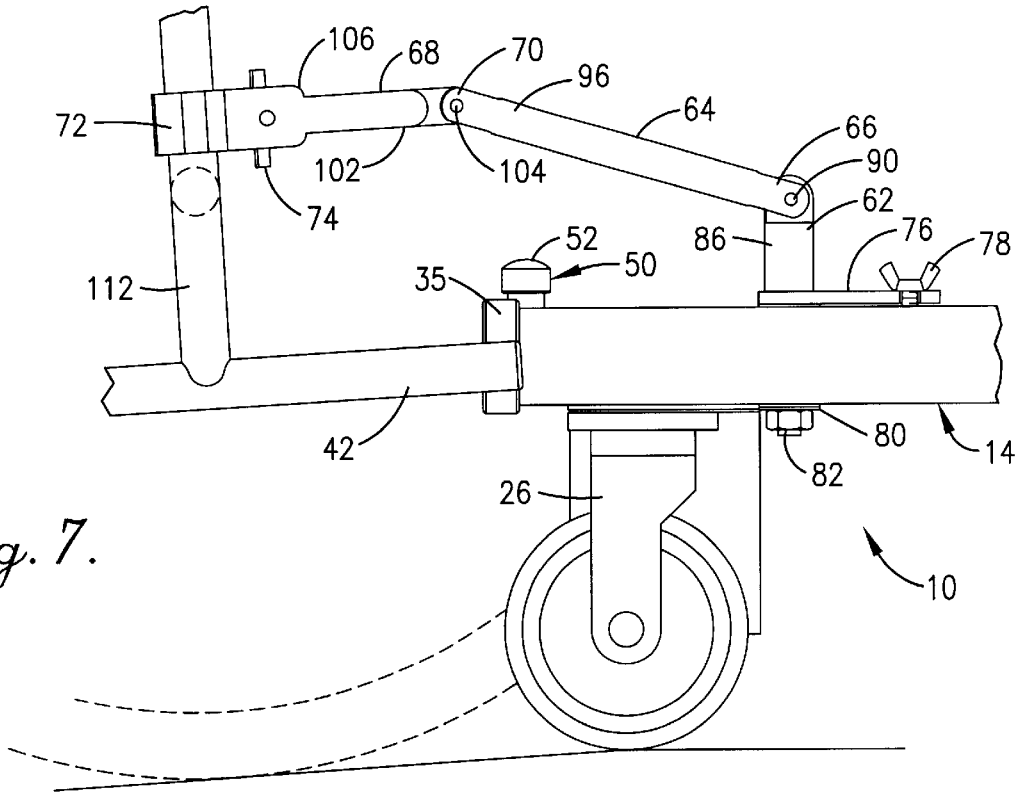

The linkage arm assemblies 30 are another preferred linkage system. Assemblies 30 are configured to allow cart 10 to be attached to a wide range of conventional wheelchairs 12. Each linkage arm assembly 30 preferably comprises an attachment pin 62, a bottom linkage arm 64, a pivoting hinge 66, a top linkage arm 68, a pivoting center joint 70 between the arms 64, 68, a clamp 72, a clamp tightener 74, a plate 76, a plate wingnut 78, a beveled washer 80, and an attachment pin lock nut 82. As shown in FIGS. 1 and 2, linkage arm assemblies 30 may be in a neutral or unconnected position wherein they rest upon either frame 14, base 16 or upon the linkage arm rests 84. Linkage arm rests 84 are secured to the legs 31 and allow the linkage arm assemblies 30 to be secured when the assemblies 30 are in the neutral position. Alternatively, linkage arm assemblies 30 may be in an extended use position as shown in FIGS. 5, 6 and 7.

Attachment pins 62, having proximal ends 86 and distal ends 88, extend through associated legs 31 and are attached to linkage arms 64 via pivoting hinges 66. Hinges 66 include elongated pins 90 which allow the linkage arms 64 to be moved through approximately an 180° arc relative to the base 16. Plates 76 lie adjacent frame 14 and have two openings, namely pin openings 92 and plate wingnut slots 94. The pins 62 are attached to plates 76 and extend through pin openings 92 and frame 14 where they are secured by means of beveled washers 80 and attachment pin locknuts 82. Washers 80 receive attachment pins 62 therethrough and lie adjacent to the frame 14 bottom. Locknuts 82 threadably receive distal ends 88 and when tightened, lie adjacent to washers 80. Wingnuts 78 are operable to secure plates 76 adjacent to frame 14. Slots 94 allow the linkage arm assemblies 30 to be swung radially about upright axes in or out to accommodate wheelchairs 12 of different widths while still holding relatively fixed positions once attachment of the cart 10 to a wheelchair 12 is completed and wingnuts 78 are tightened.

Linkage arm assemblies 30 are moveable about attachment pins 62. Linkage arms 64 are swingable from the neutral position, wherein the linkage arm distal ends 96 are aligned toward the cart back end 98, to the extended position, wherein the distal ends 96 are aligned toward the cart front 100, by pivoting about the pivoting hinges 66. Distal ends 96 are attached to top linkage arm proximal ends 102 through pivoting centerjoints 70. Joints 70 include joint pins 104 which allow pivoting of linkage arms 64 relative to linkage arms 68. Linkage arms 68 are pivotable about joints 70 allowing for accommodation and relieving of loads when traversing uneven surfaces. Linkage arms 68 terminate in clamps 72 at distal ends 106. The clamps 72 are configured to releasably secure cart 10 to a wheelchair 12 through opposing adjustable jaws 108, 110 and clamp tighteners 74, i.e. the jaws 108, 110 engage tubular downstruts 112 of a wheelchair 12 with tighteners 74 for tightening the jaws. Preferably, star-type knobs are used as the tighteners 74 to facilitate tightening and loosening of jaws 108, 110.

When a slope is encountered, the wheelchair 12 will begin its descent or ascent prior to the cart 10 thereby increasing the load on linkage arm assemblies 30. This increased load will pivot the joints 70, thereby accommodating and lessening the load. This also contributes to the stability of the cart 10 when connected to a wheelchair 12 by allowing the castors 26 to remain in contact with the ground over a wider range of loads and inclines. Linkage arms 64 and pivoting hinges 66 participate in relieving loads in an identical fashion. Advantageously, pivoting at the center joints 70 and hinges 66 contributes to the safe transportation of the patient by greatly reducing the possibility of accidentally disconnecting the cart 10 from the wheelchair 12 and the patient from any equipment to which they may be connected.

A particularly preferred embodiment of the present invention includes more than one linkage assembly to facilitate attachment to any conventional wheelchair regardless of size. Another preferred embodiment of the present invention comprises a kit operable for converting conventional carts to carts attachable to wheelchairs for rollable transportation. The kit includes at least one linkage assembly including a wheelchair attachment device, a cart attachment device, and a linker spannable between either of the attachment devices and a wheelchair. The attachment devices may include clamps, hooks, ties, hook and loop fasteners, clasps, clips, fasteners, or any other device or combination of devices capable of connecting to a wheelchair or cart. The linker may be any object capable of spanning between the cart and the wheelchair including, but not limited to linkage arms, rods, belts, cables, ropes, bands, wires, beams, lines, straps, chains and combinations of any of these.

The present invention therefore provides a quick and easy way to couple a cart 10 with a wheelchair 12 so that both may be simultaneously transported safely and efficiently by one person. The cart 10 is configured to hold equipment necessary for patient care both during and after patient transport thereby negating the need for standalone tables or shelves to hold the equipment. The equipment is held in a position that is easily accessible in emergency situations, visible at all times during transportation, difficult to accidentally contact and change operational settings during transportation, and not susceptible to damage due to incontinent patients. Furthermore, the present invention reduces the risk of backstrain caused by loading equipment onto carts for transportation and unloading this equipment to a stand-alone table once transportation is complete. Risks of damaging equipment due to dropping equipment during loading, unloading or transporting equipment are also minimized. Finally, risks associated with accidentally disconnecting a patient from any equipment are reduced by providing a coupled cart 10 and wheelchair 12 which is transportable as a single unit, even over uneven surfaces. The present invention therefore minimizes the risk that during the transporting of a patient connected to equipment, the lines connecting the patient to that equipment will be stretched and possibly become detached.

I claim:

1. A portable cart for releasable attachment to a wheelchair, the wheelchair having frame components, said cart comprising:

a base adapted to receive equipment for a person seated in the wheelchair;

a tubular frame adjacent to at least a portion of said base and presenting a pair of forwardly facing open ends, each of said open ends operable to receive a wheelchair frame component therein; and a pair of elongated pins operable to releasably secure said cart to said wheelchair frame components when said frame components are received in said open ends and permitting up and down relative movement between the cart and the wheelchair in order to afford an articulated connection between said cart and the wheelchair to pass over uneven surfaces without breaking the connection therebetween.

2. A portable cart for releasable attachment to a wheelchair, the wheelchair having frame components, said cart comprising:

a base having a holder adapted to receive equipment for a person seated in the wheelchair;

a tubular frame adjacent at least a portion of said base and presenting forward facing open ends, each of said open ends operable to receive a wheelchair frame component therein;

a pair of elongated pins operable to releasably secure said cart to said wheelchair frame components when said frame components are received in said open ends and permitting up and down relative movement between the cart and the wheelchair in order to afford an articulated connection between said cart and the wheelchair to pass over uneven surfaces without breaking the connection therebetween; and at least one elongated pivotal connector arm coupled with said base and including a coupler at the end thereof remote from said base in order to releasably couple with a frame component of the wheelchair.

3. The cart of claim 2, said hinge member including an attachment pin operatively attaching said one connector arm to said base.

4. The cart of claim 3 further comprising:

a plate secured to and radially displaceable with said attachment pin; and, a fastener releasably secured to said plate and operable for limiting radial displacement of said plate and said attachment pin.

5. The cart of claim 3, said coupler including an adjustable clamp.

6. A portable cart for releasable attachment to a wheelchair, the wheelchair having frame components, said cart comprising:

a base having a holder adapted to receive equipment for a person in the wheelchair;

at least one elongated pivotal connector arm coupled with said base and including a clamp at the end thereof remote from said base in order to releasably clamp with a frame component of the wheelchair, said connector arm having a pair of pivotally interconnected arm segments, one of said arm segments including a hinge member pivotally coupling the one arm segment to said base, said pivotally interconnected arm segments permitting relative pivoting between the arm segments and up and down relative movement between the cart and the wheelchair in order to afford an articulated connection between the cart and the wheelchair allowing the cart and wheelchair to pass over uneven surfaces without breaking the connection therebetween;

said hinge member including an attachment pin operatively attaching said one connector arm to said base;

a plate secured to and radially displaceable with said attachment pin; and a fastener releasably secured to said plate and operable for limiting radial displacement of said plate and said attachment pin.

* * * * *